US007168504B2

(12) United States Patent
Hetcher et al.

(10) Patent No.: US 7,168,504 B2
(45) Date of Patent: Jan. 30, 2007

(54) ROTARY HAMMER INCLUDING BREATHER PORT

(75) Inventors: Jason D. Hetcher, Waukesha, WI (US); David R. Bauer, Delafield, WI (US); Dragomir C. Marinkovich, Hales Corners, WI (US); Michael E. Weber, Hartland, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 11/348,117

(22) Filed: Feb. 6, 2006

(65) Prior Publication Data

US 2006/0124334 A1 Jun. 15, 2006

Related U.S. Application Data

(63) Continuation of application No. 10/245,001, filed on Sep. 17, 2002, now Pat. No. 7,032,683.

(60) Provisional application No. 60/322,958, filed on Sep. 17, 2001.

(51) Int. Cl.
*E21B 10/22* (2006.01)

(52) U.S. Cl. ..... 173/104; 173/213; 173/DIG. 3

(58) Field of Classification Search ..... 173/104, 173/109, 201, 213, DIG. 3; 92/153
See application file for complete search history.

(56) References Cited

U.S. PATENT DOCUMENTS

| | | | |
|---|---|---|---|
| 2,135,861 | A | 11/1938 | Thompson |
| 2,239,090 | A | 4/1941 | Everett |
| 2,702,534 | A | 2/1955 | Keylwert |
| 3,425,705 | A | 2/1969 | Benjamin et al. |
| 3,559,751 | A | 2/1971 | Yamada |
| 3,583,716 | A | 6/1971 | Daniel, Jr. |
| 3,650,336 | A | 3/1972 | Koehler |
| 3,685,594 | A | 8/1972 | Koehler |

(Continued)

FOREIGN PATENT DOCUMENTS

| | | |
|---|---|---|
| DE | 2709616 | 9/1978 |

(Continued)

OTHER PUBLICATIONS

Michael Monteabaro, Rotary Hammers, Tools of the Trade (magazine), Fall, 1996.

*Primary Examiner*—Scott A. Smith
*Assistant Examiner*—Gloria R. Weeks
(74) *Attorney, Agent, or Firm*—Michael Best & Friedrich LLP

(57) ABSTRACT

A rotary hammer and a power tool. The rotary hammer is operable in an idle mode and a hammer mode and comprises a housing and a barrel positioned in the housing and having a forward portion. A ram is positioned within the barrel and is movable relative to the barrel between hammering positions and an idle position. In some aspects, a ram catcher assembly is positioned along the axis adjacent the forward portion of the barrel to releasably hold the ram in the idle position. The ram catcher assembly includes a friction member frictionally engageable with the ram and a damping member at least partially surrounding the friction member. As the ram moves to the idle position with a force, the damping member absorbs at least a portion of the force and the member applies friction to the ram.

27 Claims, 14 Drawing Sheets

U.S. PATENT DOCUMENTS 3,750,283 A 8/1973 Hoffman
3,835,935 A 9/1974 Sides et al.
3,921,729 A 11/1975 Schmuck
3,927,893 A 12/1975 Dillon et al.
3,929,195 A 12/1975 Stiltz et al.
3,945,653 A 3/1976 Falchle
4,041,729 A 8/1977 Bilz
4,064,949 A 12/1977 Chromy
4,131,165 A 12/1978 Wanner
4,184,692 A 1/1980 Benson et al.
4,197,044 A 4/1980 Cummings
4,232,749 A 11/1980 Rohrbach
4,266,895 A 5/1981 Lewis
4,284,148 A 8/1981 Wanner et al.
4,332,340 A 6/1982 Harris
4,336,847 A 6/1982 Ito et al.
4,349,074 A 9/1982 Ince
4,431,062 A 2/1984 Wanner et al.
4,434,859 A 3/1984 Rumpp et al.
4,442,906 A 4/1984 Simpson
RE31,755 E 12/1984 Wanner et al.
4,502,824 A 3/1985 Dohse et al.
4,570,587 A * 2/1986 Watanabe et al. ..... 123/193.6
4,577,875 A 3/1986 Miyakawa
4,579,092 A 4/1986 Kandler
4,585,077 A 4/1986 Bergler
4,611,670 A 9/1986 Chromy
4,626,146 A 12/1986 Neumaier
4,626,152 A 12/1986 Palm
4,688,975 A 8/1987 Palm
4,691,929 A 9/1987 Neumaier et al.
4,701,083 A 10/1987 Deutschenbaur et al.
4,708,548 A 11/1987 Taylor et al.
4,750,567 A 6/1988 Grossmann et al.
4,766,859 A * 8/1988 Miyaki et al. ..... 123/196 W
4,818,157 A 4/1989 Kouvelis
4,824,003 A 4/1989 Almeras et al.
4,945,998 A * 8/1990 Yamanaka ..... 173/207
5,028,057 A 7/1991 Wanner
5,036,925 A 8/1991 Wache
5,050,687 A 9/1991 Prokhorov et al.
5,056,607 A 10/1991 Sanders
5,076,371 A 12/1991 Obermeier et al.
5,111,890 A 5/1992 Ranger et al.
5,199,508 A 4/1993 Miyanaga
5,199,833 A 4/1993 Fehrle et al.
5,340,245 A 8/1994 Bloechle et al.
5,427,482 A 6/1995 Asano et al.
5,429,457 A 7/1995 Asano et al.
5,435,397 A 7/1995 Demuth
5,447,205 A 9/1995 Thurler
5,464,229 A 11/1995 Salpaka
5,577,743 A 11/1996 Kanaan et al.
5,709,393 A 1/1998 von Keudell et al.
5,852,992 A 12/1998 Boggs et al.
5,871,059 A 2/1999 Shibata et al.
5,873,418 A 2/1999 Arakawa et al.
5,887,678 A * 3/1999 Lavender ..... 184/11.2
5,903,983 A 5/1999 Jungmann et al.
5,911,281 A 6/1999 Treskog et al.
5,934,846 A 8/1999 Ishii
5,954,140 A 9/1999 Bauer
5,954,347 A 9/1999 Buck et al.
5,971,403 A 10/1999 Yahagi et al.
5,984,027 A 11/1999 Kato
5,984,596 A 11/1999 Fehrle et al.
5,996,451 A 12/1999 Seber et al.
5,996,452 A 12/1999 Chiang
5,996,708 A 12/1999 Gerold
6,015,017 A 1/2000 Lauterwald
6,035,945 A 3/2000 Ichijyou et al.
6,047,678 A 4/2000 Kurihara et al.
6,059,162 A 5/2000 Popovich et al.
6,092,814 A 7/2000 Kageler
6,098,723 A 8/2000 Yaniero et al.
6,116,352 A 9/2000 Frauhammer et al.
6,123,243 A 9/2000 Pfister et al.
6,155,356 A 12/2000 Kikuchi et al.
6,192,996 B1 2/2001 Sakaguchi et al.
6,199,383 B1 3/2001 Pusateri
6,220,495 B1 4/2001 Jakob
6,227,309 B1 5/2001 Henke et al.
6,237,699 B1 5/2001 Plietsch
6,478,207 B2 11/2002 Ehmig et al.
6,536,647 B2 3/2003 Buchel et al.
6,732,815 B2 5/2004 Hanke et al.
6,739,406 B2 * 5/2004 Lebisch et al. ..... 173/213
6,779,698 B2 8/2004 Lin
2002/0130155 A1 9/2002 Bonig et al.
2003/0121683 A1 7/2003 Lebisch et al.
2003/0121684 A1 7/2003 Lebisch et al.
2003/0201110 A1 * 10/2003 Bednar ..... 173/216
2006/0096768 A1 * 5/2006 Ookubo ..... 173/48

FOREIGN PATENT DOCUMENTS

DE 3022807 1/1982
DE 3307521 9/1984
DE 3040464 11/1992
DE 4241626 6/1994
DE 10045618 4/2002
DE 10045620 4/2002
EP 1048415 11/2000
GB 1181125 2/1970
GB 1365574 9/1974
GB 1512214 5/1978
GB 2084916 4/1982
GB 2085795 5/1982
GB 2115337 9/1983
GB 2136725 9/1984
GB 2141659 1/1985
GB 2147240 1/1985
GB 2192824 1/1988
GB 2410212 7/2005
JP 2437023 2/1976
WO WO 02062534 8/2005

* cited by examiner

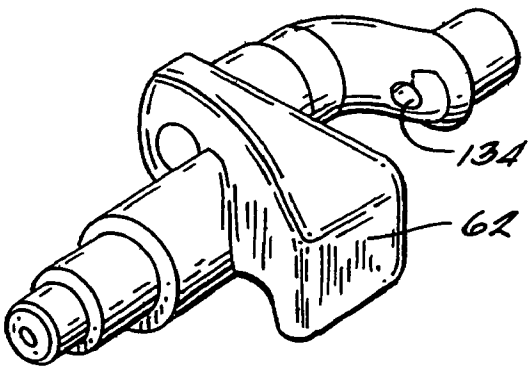
Fig. 5
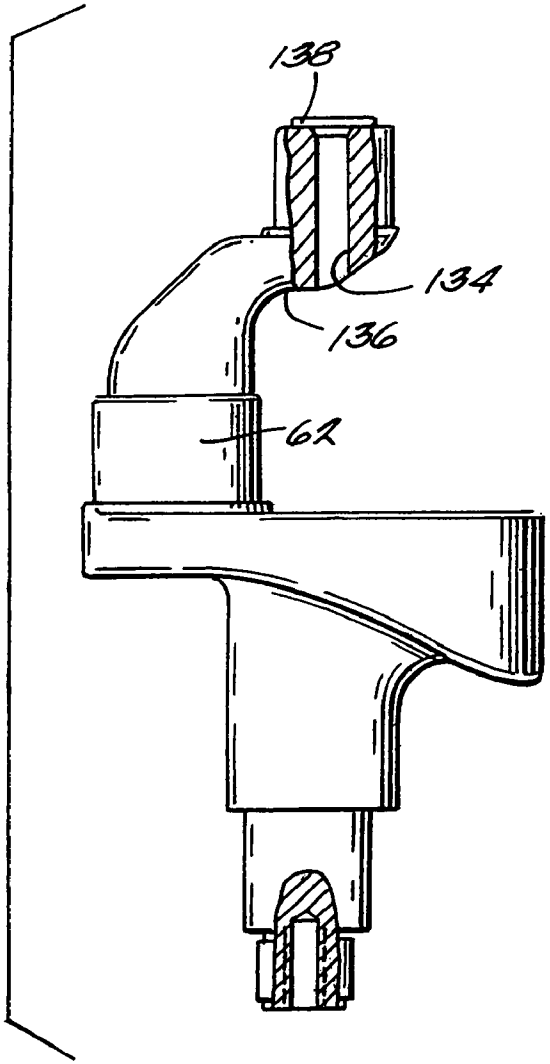

ROTARY HAMMER INCLUDING BREATHER PORT

RELATED APPLICATIONS

This application is a continuation of prior filed patent application Ser. No. 10/245,001, U.S. Pat. No. 7,032,683, filed Sep. 17, 2002, which claims priority under 35 U.S.C. § 119 to co-pending U.S. Provisional Application Ser. No. 60/322,958, filed Sep. 17, 2001, the entire contents of both of which are hereby incorporated by reference.

FIELD OF THE INVENTION

The present invention relates to power tools and, more particularly, to a drive system and a bit retention device for a power tool, such as a rotary hammer.

BACKGROUND OF THE INVENTION

In general, rotary hammers operate to impart both rotational, drilling movement and axial, hammering movement on a tool bit. In this regard, rotary hammers include both a rotary drive system and an axial drive system. One axial drive system includes a pneumatic drive system which uses an axially reciprocating piston to drive the bit.

SUMMARY OF THE INVENTION

One independent problem with existing rotary hammers is that, when the hammer is changed from hammer mode to idle mode, the ram may rebound and/or be drawn by the reciprocating piston back into the hammer mode.

Another independent problem with existing rotary hammers is that, when the ram impacts the cushion or damping member (i.e., to absorb the force of the ram as it moves to idle mode), intense heat is generated on that damping member. This intense heat can cause the physical properties of the damping member to be changed and, possibly, can cause the damping member to fail.

Yet another independent problem with existing rotary hammers is that, when the ram moves to the idle position, the air in front of the ram is vented and is not used to brake the velocity of the ram.

A further independent problem with existing power tools is that, as the power tool operates and heats up, a positive pressure builds up in the sealed crankcase, and this pressure forces air and grease past the crankcase seals and into the rest of the power tool.

Another independent problem with existing rotary hammers it that the bit retention device includes numerous components and is complex. Operation of these components can thus be easily disrupted.

The present invention provides a rotary hammer which substantially alleviates one or more of the above-described and other problems with existing power tools and rotary hammers. In one aspect of the invention, the rotary hammer includes a ram catcher assembly including an annular soft material damping member to absorb the force of the ram and an annular hard material friction member surrounded by the damping member and movable radially by the damping member to frictionally engage the ram and hold the ram in the idle position. In another aspect of the invention, the rotary hammer is constructed to cool the damping assembly, for example, by passing air over and/or through the damping assembly. In yet another aspect of the present invention, the rotary hammer includes an air brake ram catcher utilizing a volume of air captured in front of the ram to reduce the velocity of the ram as the ram moves to the idle position.

In a further aspect of the invention, the rotary hammer includes a breather port defined in one end of the rotating crank shaft to vent air to the atmosphere and to reduce the pressure in the crankcase. In another aspect of the invention, the rotary hammer includes a bit retention device including a transversely-extending pin which is radially movable into an out of engagement with the bit to retain the bit.

More particularly, the present invention provides a rotary hammer operable in an idle mode and a hammer mode, the hammer including a housing, a barrel positioned in the housing and having a forward portion, a ram positioned within the barrel and movable relative to the barrel between hammering positions and an idle position, and a ram catcher assembly supported adjacent the forward portion of the barrel to releasably hold the ram in the idle position. The ram catcher assembly is defined as including a friction member frictionally engageable with the ram, and a damping member and at least partially surrounding the friction member. As the ram moves to the idle position with a force, the damping member absorbs at least a portion of the force and the friction member applies friction to the ram.

Also, the present invention provides a rotary hammer operable in an idle mode and a hammer mode, the hammer including a housing, a barrel supported in the housing and having a forward end, the forward end defining a port, a ram positioned in the barrel and movable relative to the barrel between a hammering position and an idle position, and a damping member supported adjacent the forward end of the barrel and engageable with the ram to absorb a force of the ram as the ram moves toward the idle position. The damping member defines a central aperture extending axially through the damping member, a plurality of radially extending grooves communicating with the central aperture, and a circumferentially extending groove communicating with the plurality of radially extending grooves. Air passing through the port and over the damping member along the radially extending grooves and the circumferentially extending groove cools the damping member.

In addition, the present invention provides a rotary hammer operable in an idle mode and a hammer mode, the hammer including a housing, a barrel positioned in the housing and having a forward portion defining ports, and a ram positioned within the barrel and movable relative to the barrel between hammering positions and an idle position. The openings are configured to trap a volume of air in front of the ram to reduce the velocity of the ram as the ram moves to the idle position and to, thereafter, release the volume of air to allow the ram to move to the idle position.

Further, the present invention provides a power tool including a housing, a crankcase assembly supported in the housing and having a wall defining an interior portion, grease being retained within the crankcase assembly, a shaft rotatably supported in the crankcase assembly, the shaft having an end extending through a wall, the shaft defining a breather port in the end, the breather port communicating between an interior portion of the crankcase assembly and atmosphere, the breather port having an interior end and an atmosphere end, the interior end of the shaft providing a slinger surface adjacent to the breather port, rotation of the shaft preventing grease from entering the breather port, and a permeable cover positioned over the atmosphere end of the breather port. Operation of the power tool causes pressure buildup in the crankcase assembly, and the pressure is vented from the crankcase assembly through the breather port.

Also, the present invention provides a rotary hammer for use with a tool element having an end and a transverse groove defined in the end. The hammer is defined as including a housing, a drive mechanism supported by the housing and operable to rotatably and reciprocatingly drive the tool element, a chuck operably connected to the drive mechanism, and a retaining device operable to selectively retain the tool element in the chuck. The retaining device is defined as including a transversely-extending pin having a first end and a second end, the pin being moveable between a locked position, in which the pin engages the groove in the tool element to retain the tool element in the chuck, and an unlocked position, in which pin is disengaged from the groove, and an actuating assembly operable to move the pin from the locked position to the unlocked position and from the unlocked position to the locked position. The actuating assembly is defined as including an actuator engaging the first end and the second end of the pin, and a biasing member biasing the actuator to move the pin toward the locked position.

In addition, the present invention provides methods of operating a rotary hammer.

One independent advantage of the present invention is that, in some aspects of the invention, the rotary hammer includes a two-piece ram catcher providing increased energy absorption, with the soft-plastic damping member, and increased frictional interference, with the hard friction member, to better catch and retain the ram in the idle position.

Another independent advantage of the present invention is that, in some aspects of the invention, the rotary hammer is configured to cool the damping member, for example, by passing air across the damping member, and to maintain the desired physical properties of the damping member.

Yet another independent advantage of the present invention is that, in some aspects of the invention, the rotary hammer is configured to trap a volume of air in front of the ram to absorb the force of the ram as the ram moves to the idle position and to release the volume of air to allow the ram to move to the idle position.

A further advantage of the present invention is that, in some aspects of the invention, the rotary hammer includes a rotating shaft, such as the crank shaft, defining a breather port to vent air and to reduce the pressure in the crankcase, the rotation of the shaft preventing grease from escaping through the port.

Another independent advantage of the present invention is that, in some aspects of the invention, the bit retention device is less complex and easier to operate.

Other independent features and independent advantages of the invention will become apparent to those skilled in the art upon review of the following detailed description and drawings.

BRIEF DESCRIPTION OF THE DRAWINGS

FIG. 5 are views of a crank shaft shown in FIG. 1.

Figure 1:
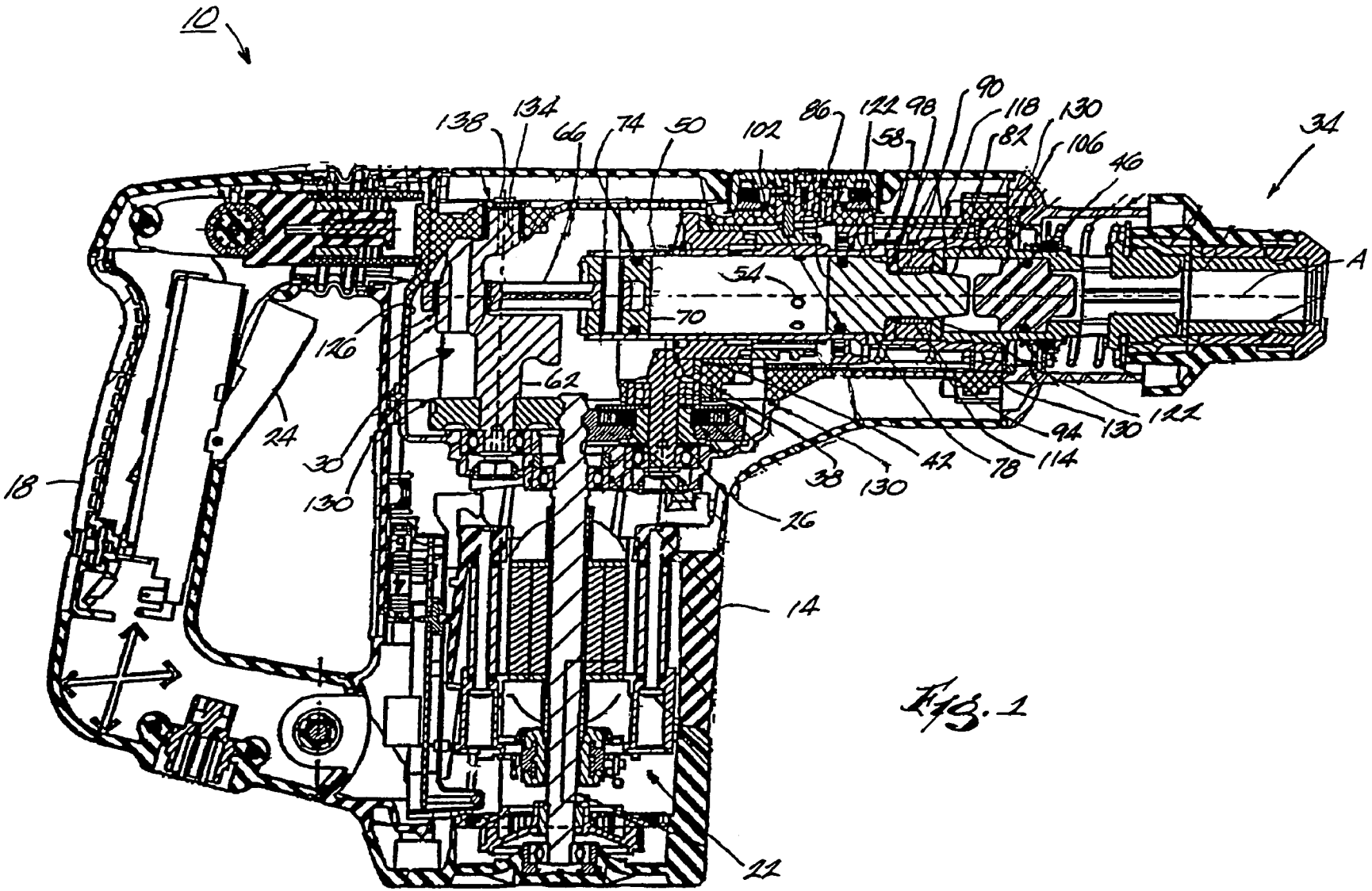
FIG. 1 is a partial cross-sectional side view of a rotary hammer embodying the present invention.

Before one embodiment of the invention is explained in detail, it is to be understood that the invention is not limited in its application to the details of the construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting.

DETAILED DESCRIPTION OF THE PREFERRED EMBODIMENT

Figure 6A:
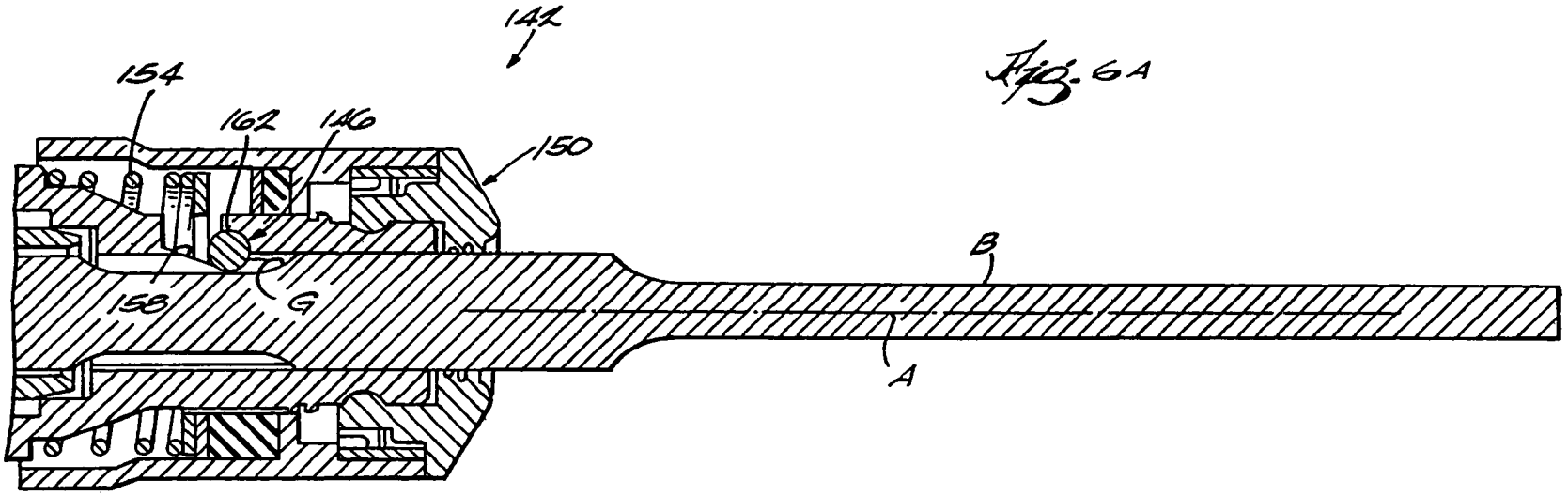
FIG. 6A is a partial cross-section side view of an alternative construction of a bit retainer device in a locked device.

A power tool, such as, for example, a rotary hammer 10 embodying aspects of the present invention, is illustrated in FIG. 1. The hammer 10 includes a housing 14, an operator's grip or handle 18, an electric motor 22 connectable to a power source (not shown) by an on/off switch 24, a rotary drive system 26, and a reciprocating drive system 30. The hammer 10 also includes a tool holder or chuck 34 for supporting a tool element or bit B (shown in FIGS. 6–8). The bit B has an end for engaging a workpiece (not shown) and a rearward end. A groove G is defined adjacent the rearward end. When supported in the chuck 34, the bit B defines an axis A of the hammer 10.

As explained below, the hammer 10 selectively drives the bit B for both rotary drilling motion about the axis A and for reciprocating or hammering motion along the axis A. As also explained below, the hammer 10 has a hammering mode (not shown), in which the hammer 10 provides rotary and reciprocating/hammering motion to the bit B, and an idle mode (shown in FIGS. 1 and 2*a*), in which the hammer 10 does not provide reciprocating/hammering motion to the bit B.

In general, the rotary drive system 26 includes (see FIG. 1) a pinion 38, which is driven by the motor 22 and which drives a gear 42. A spindle 46 is rotatably driven by the pinion 38 and the gear 42, and rotation of the spindle 46 causes the bit B to rotate for rotational, drilling movement about the axis A. It should be understood that another rotary drive mechanism, similar to the assembly of the pinion 38 and the gear 42, may be used to rotatably drive the spindle 46 about the axis A.

The cylindrical spindle 46 is hollow and forms a support member for at least a portion of the reciprocating drive system 30. The reciprocating drive system 30 includes a hollow cylindrical barrel 50 having a barrel axis which is aligned with the axis A. At least one idle port 54 is formed through the sidewall of the barrel 50. A forward portion of the barrel 50 is defined between the idle ports 54 and the forward end of the barrel 50, and a rearward portion of the barrel 50 is defined between the idle ports 54 and the rearward end of the barrel 50. At least one forward port 58 is formed in the sidewall of the barrel 50 adjacent the forward end.

The reciprocating drive system 30 also includes a crank shaft 62 (see FIGS. 1 and 5) which is rotatably driven by the motor 22 and which reciprocates a connecting rod 66. A reciprocating piston 70 is connected to and reciprocated by the crank shaft 62 and the connecting rod 66. The reciprocating piston 70 is supported in the barrel 50 for axial movement relative to the barrel 50. The barrel 50 and the piston 70 thus form a piston and cylinder assembly. The piston 70 includes a piston seal 74 which forms a seal between the piston 70 and the sidewall of the barrel 50.

Figure 2A:
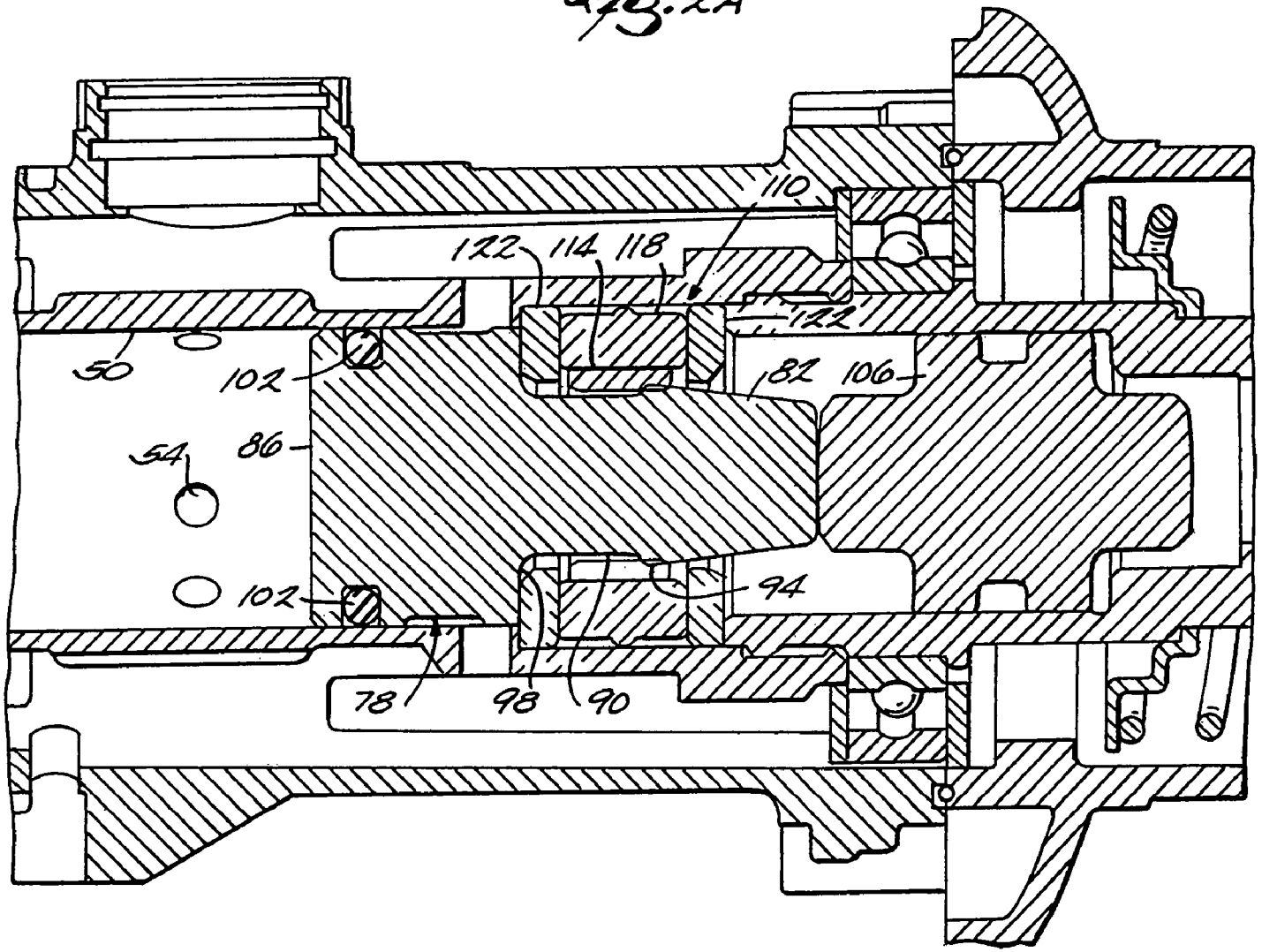
FIG. 2A is an enlarged portion of the rotary hammer of FIG. 1 in an idle position.
Figure 2B:
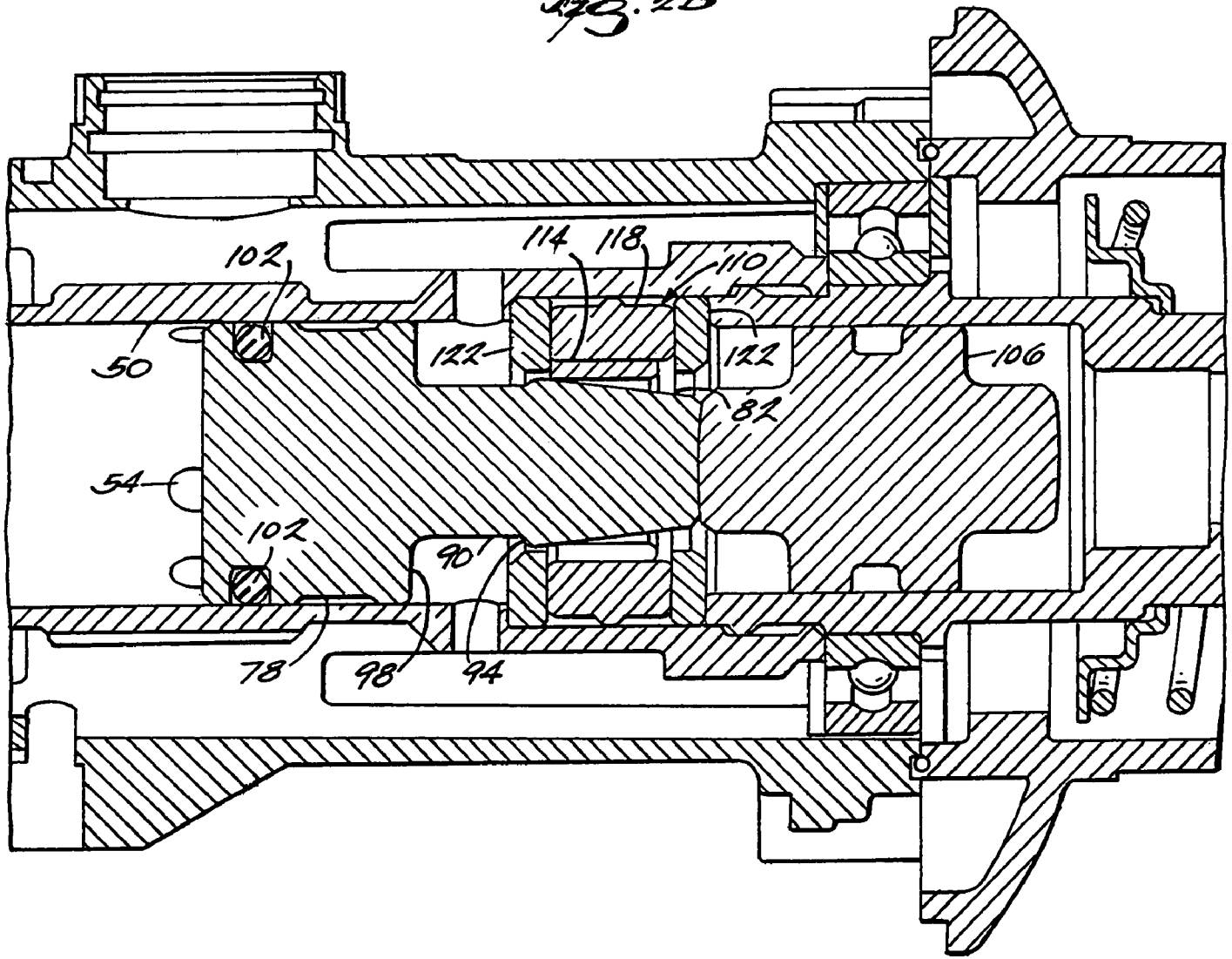
FIG. 2B is the portion of the rotary hammer shown in FIG. 2A in a forward hammering position.
Figure 2C:
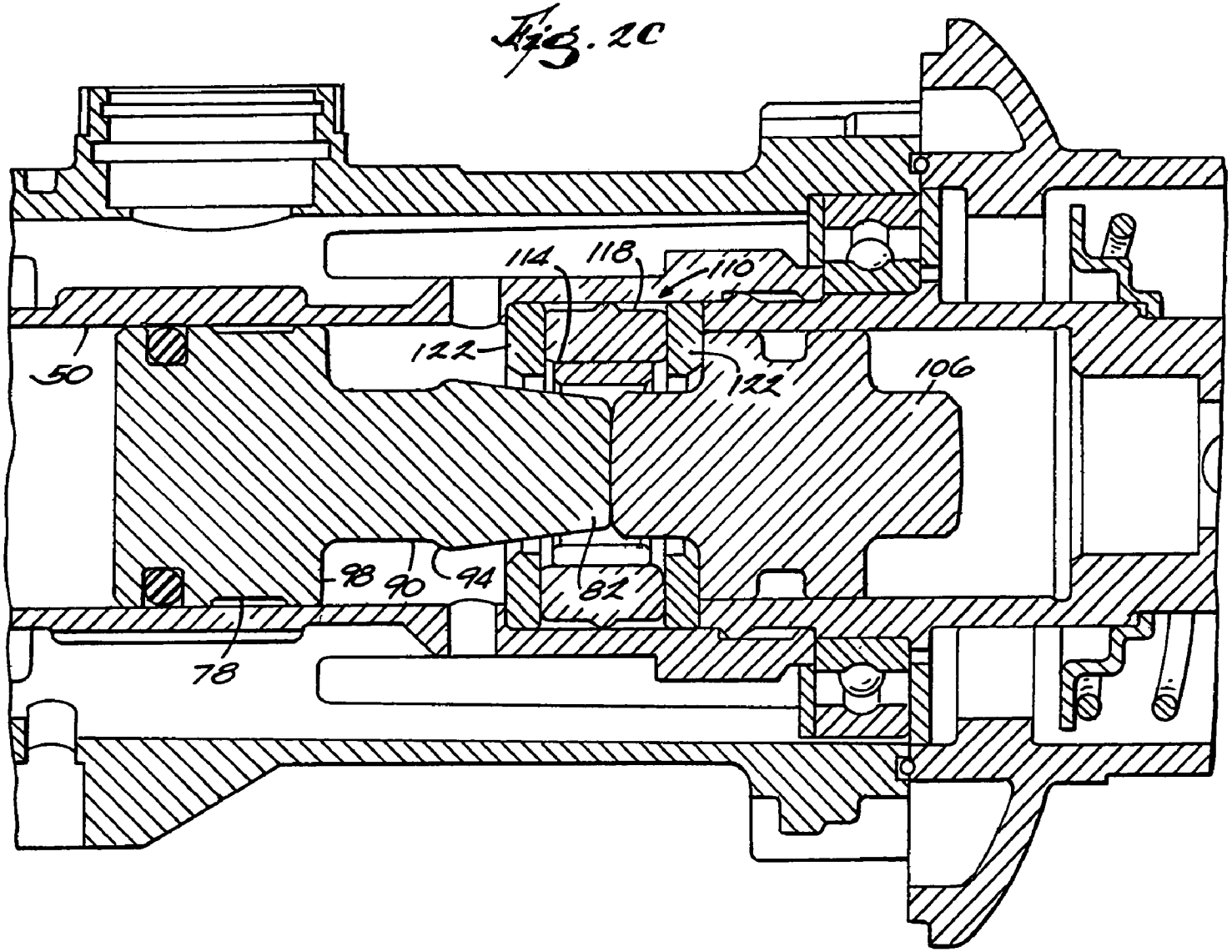
FIG. 2C is the portion of the rotary hammer shown in FIG. 2A in a retracted hammering position.

The reciprocating drive system 30 also includes a ram 78 supported in the barrel 50 for axial movement relative to the barrel 50 between hammering positions, such as a rearward or retracted hammering position (FIG. 2C) and a forward hammering position (shown in FIG. 2B), and between the hammering positions and an idle position (shown in FIGS. 1 and 2A). The ram 78 has a forward nose portion 82, a main body portion 86 and an intermediate portion 90 between the portions 82 and 86. An annular ridge 94 is formed at the junction of the portions 82 and 90, and an annular surface 98 is formed at the junction between the portions 86 and 90. The ram 78 also includes a ram seal 102 which forms a seal between the ram 78 and the sidewall of the barrel 50.

The reciprocating drive system 30 also includes a striker 106. The striker 106 has a forward end which normally engages the bit B and a rearward end which is engageable with the ram 78. The striker 106 is supported by the spindle 46 and is axially movable relative to the spindle 46 between a forward position and a rearward position.

In operation, the hammer 10 is connected to an electrical power source, and the operator engages the on/off switch 24. The motor 22 drives both the rotary drive system 26 and the reciprocating drive system 30. The rotary drive system 26 drives the spindle 46 in a rotary motion in the selected direction to rotate the bit B in the selected direction. The reciprocating piston 70 is driven by the motor 22, though this will not cause hammering movement of the bit B unless then hammer 10 is placed in the hammer mode.

In the idle mode (shown in FIGS. 1 and 2A), the hammer 10 does not impart the axial, reciprocating hammer motion on the bit B. In the idle mode, the idle ports 54 are in a port open position with the idle ports 54 being open to the atmosphere surrounding the hammer 10. In this position, as the piston 70 reciprocates, air moves into and out of the space between the piston 70 and the ram 78 through the idle ports 54. A vacuum is not created in this space, and, therefore, the ram 78 is not caused to reciprocate.

To change the hammer 10 from the idle mode to the hammer mode, in the illustrated construction, the operator engages the bit B against the workpiece. The bit B is moved rearwardly, and the rearward end of the bit B engages the striker 106, causing the striker 106 to move rearwardly. The rearward end of the striker 106 engages the forward nose portion 82 of the ram 78 and causes the ram 78 to move rearwardly. As the ram 78 moves rearwardly (see FIG. 2B), the ram 78 covers the idle ports 54 and closes the idle ports 54 (see FIG. 2C in which the ram seal 102 is removed to illustrate the ram 78 covering the idle ports) from the atmosphere surrounding the hammer 10. The idle ports 54 are now in a port closed position, and the hammer 10 is in the hammer mode.

With the idle ports 54 closed, a vacuum is created in the space between the piston 70 and the ram 78. As the piston 70 moves rearwardly, the ram 78 is also drawn rearwardly by the force of the vacuum. Air moves through the forward ports 58 into the space between the ram 78 and the striker 106 so that a vacuum is not also created on this side of the ram 78. The ram 78 continues rearwardly and compresses the air in the space between the piston 70 and the ram 78.

As the piston 70 begins its forward stroke, the air between the piston 70 and the ram 78 reaches its maximum compression. The ram 78 is forced forwardly by the forward movement of the piston 70 and by the expansion of the air in the space between the piston 70 and the ram 78. As the ram 78 moves forward, air moves through the forward ports 58 out of the space between the ram 78 and the striker 106 so that the forward movement of the ram 78 is not substantially impeded. The ram 78 slams into the striker 106 and the striker 106 slams into the bit B. This is one hammer cycle. The hammer 10 continues to operate in the hammer mode as the piston 70 reciprocates as long as the idle ports 54 are covered by the ram 78 and in the port closed position.

To disengage the hammer mode in the illustrated construction, the operator disengages the bit B from the workpiece. With the removal of the rearward force on the bit B, the bit B, the striker 106 and the ram 78 are able to move to their respective forward-most positions (shown in FIGS. 1 and 2C). At the end of the last hammer cycle, the ram 78 moves to its forward-most position, uncovering the idle ports 54 so that the idle ports 54 are in the port open position and are open to the atmosphere. As the piston 70 reciprocates, air moves into and out of the space between the piston 70 and the ram 78, and a vacuum is not created in this space.

To maintain the ram 78 in its forward-most position and to maintain the hammer 10 in the idle mode, in some aspects of the invention, the hammer 10 includes a ram catcher assembly 110. The ram catcher assembly 110 includes a friction member 114 (see FIGS. 3A and 3B), which is frictionally engageable the ram 78, and an annular soft-plastic damping member 118 (see FIG. 4), which surrounds the friction member 114.

Figure 3A:
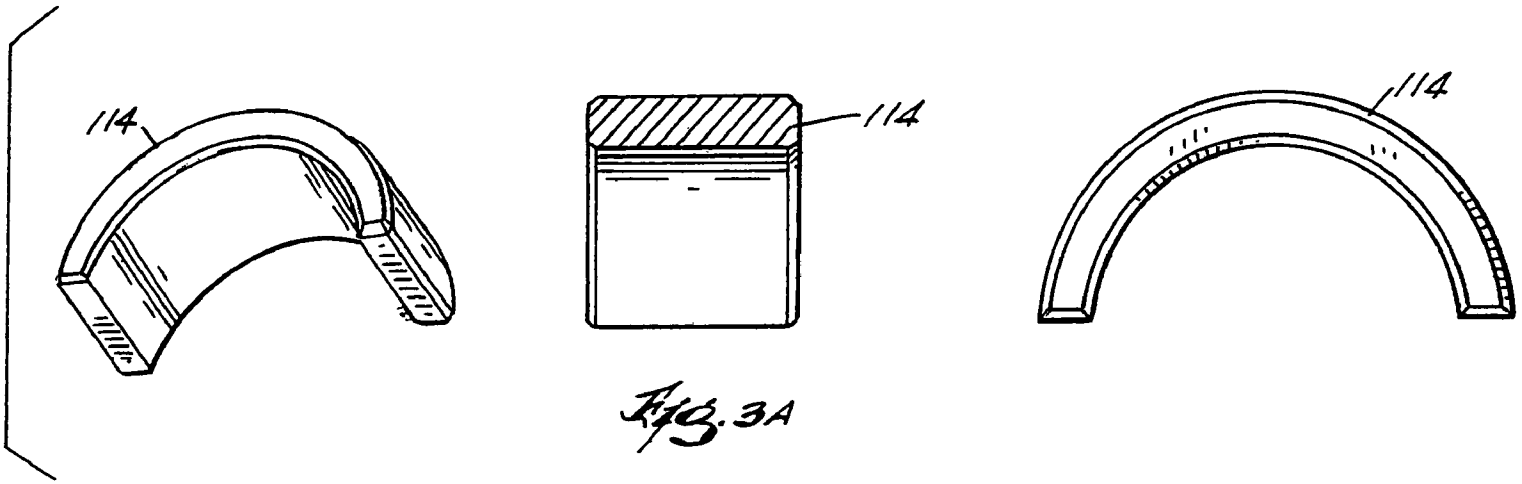
FIG. 3A are views of a friction member shown in FIG. 1.
Figure 3B:
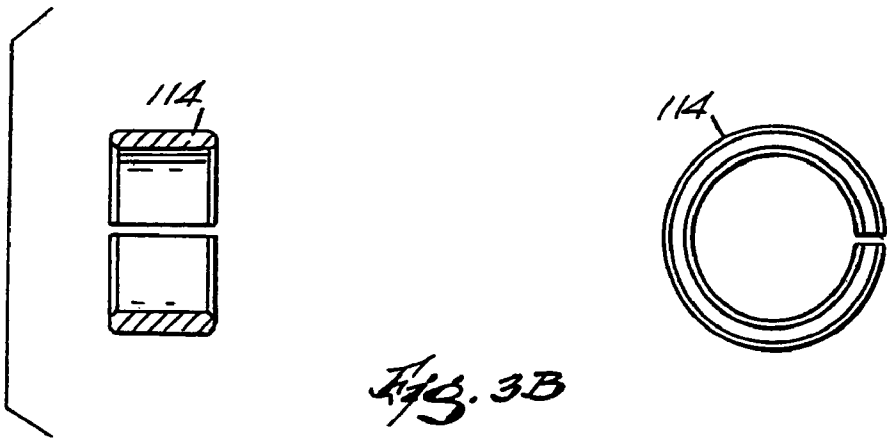
FIG. 3B are views of a friction member shown in FIG. 1 having an alternate contour.
Figure 4:
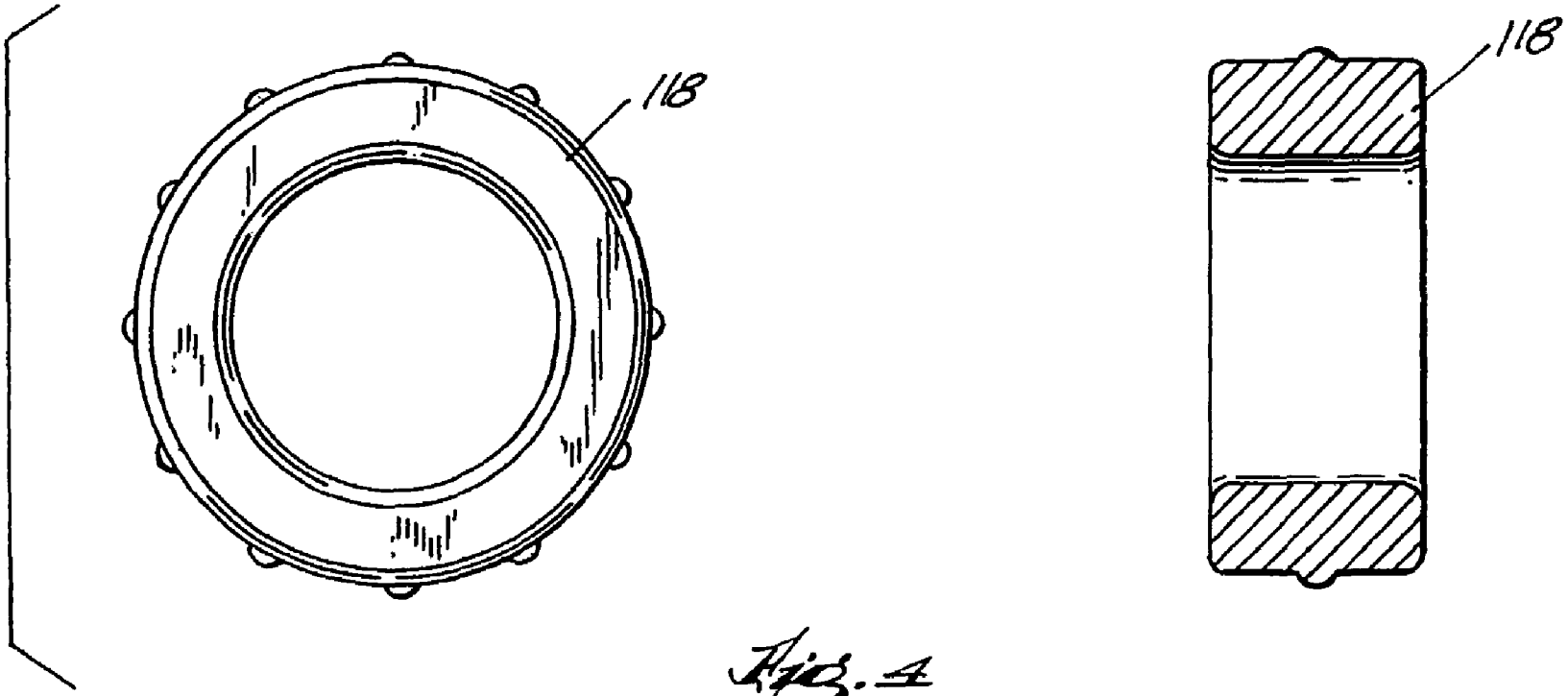
FIG. 4 are views of a damping member shown in FIG. 1.

In the construction shown in FIG. 3A, the friction member 114 is formed of two substantially C-shaped pieces, which are arranged to substantially surround the ram 78 in its forward-most position and can be moved and compressed radially inwardly. Preferably, the friction member 114 is made of a hard material, such as, for example, steel, having good strength, durability and friction qualities. However, in other constructions, the friction member 114 may be formed of other relatively hard, non-flexible materials, such as, for example, other metals, hard-plastics, rubbers, etc. As shown in FIG. 3B, in an alternate construction, the friction member 114 is formed as a sleeve which is split parallel to its axis, allowing the friction sleeve 114 to expand and compress radially.

It should be understood that, in other constructions (not shown), the friction member 114 may be arranged to surround only a circumferential portion of the ram 78. It should also be understood that, in other constructions (not shown), the friction member 114 may include more than two pieces arranged to apply friction to the ram 78.

In the illustrated construction, the damping member 118 is formed of a relatively soft material, such as, for example, an elastomeric material, having the characteristics to absorb the kinetic energy of the ram 78 as the hammer 10 moves from the hammer mode to the idle mode and to apply a radially-inward directed force on the friction member 114. Preferably, the damping member 118 is formed of polyacrylate. In other constructions, the damping member 118 may be formed of other materials, such as, for example, fluoroelastomer (sold under the trade name VITON® by DuPont Dow Elastomers L.L.C., 300 Bellevue Parkway, Wilmington, Del.). Washers 122 are positioned on each axial end surface of the damping member 118.

As the hammer 10 moves from the hammer mode to the idle mode, as described above, the forward nose portion 82 of the ram 78 contacts the inner surface of the friction member 114, and the annular surface 98 of the body portion 86 of the ram 78 strikes the rear washer 122. Engagement of the body portion 86 and the rear washer 122 and continued forward movement of the ram 78 to the idle position causes the damping member 118 to axially compress. As the damping member 118 axially compresses, the damping member radially expands or bulges, increasing the radial pressure on the inner surface of the barrel 50 and on the friction member 114. The radial pressure on the outer diameter of the friction member 114 causes the friction member 114 to move inwardly radially and radially compress and grab the nose portion 82 of the ram 78.

The damping member 118 absorbs the axial force of the ram 78, and the friction member 114 radially compresses and frictionally engages the outer surface of the forward nose portion 82 of the ram 78. The combination of the soft, force-absorbing damping member 118 and the hard, interference-engaging friction member 114 reduces the rebound of the ram 78 and ensures that the hammer 10 stays in the idle mode. The two-piece ram catcher assembly 110 maintains the damping properties of the soft material of the damping member 118 while benefiting from the interference engagement of the hard material of the friction member 114.

As shown in FIG. 1, components of the hammer 10, such as the reciprocating drive system 30 and portions of the rotary drive system 26, are sealed in a crankcase 126. Junctions of the crankcase 126 are sealed by O-rings 130. The crankcase 126 is at least partially filled with grease to lubricate the moving components which are supported within the crankcase 126.

During operation of the hammer 10, movement of the components in the crankcase 126 causes heat, and this heat causes pressure to build up in the crankcase 126. In some aspects of the invention, to vent air from the sealed crankcase 126 and to prevent air and grease from being forced past the O-rings, a breather port 134 (see FIG. 5) is defined in one end of the crank shaft 62. As shown in FIG. 1, the breather port 134 communicates between the interior of the crankcase 126 and atmosphere. Also, the crank shaft 62 defines a slinger surface 136, which is adjacent to the breather port 134.

During operation of the hammer 10, air is vented through the breather port 134, and grease is prevented from escaping through the breather port 134 by the rotation of the crank shaft 62 and, more specifically, by the slinger surface 136, which flings grease away from the breather port 134. Centrifugal force causes the grease to be thrown away from the breather port 134. In this way, only air can reach the breather port 134 and be vented to the atmosphere. A porous material, such as a felt piece or a foam pad 138, covers the outer atmosphere end of the breather port 134. The foam pad 138 substantially prevents grease which may enter the breather port 134 (i.e., when the hammer 10 is left in an inverted position in a non-operating condition) from exiting the atmosphere end of the breather port 134.

It should be understood that, in other constructions (not shown), a breather port may be formed through another rotating component communicating with the interior of the sealed crankcase 126, such as through the other end of the rotating crank shaft 62 or through the rotating pinion 38 of the rotary drive system 26.

Figure 6B:
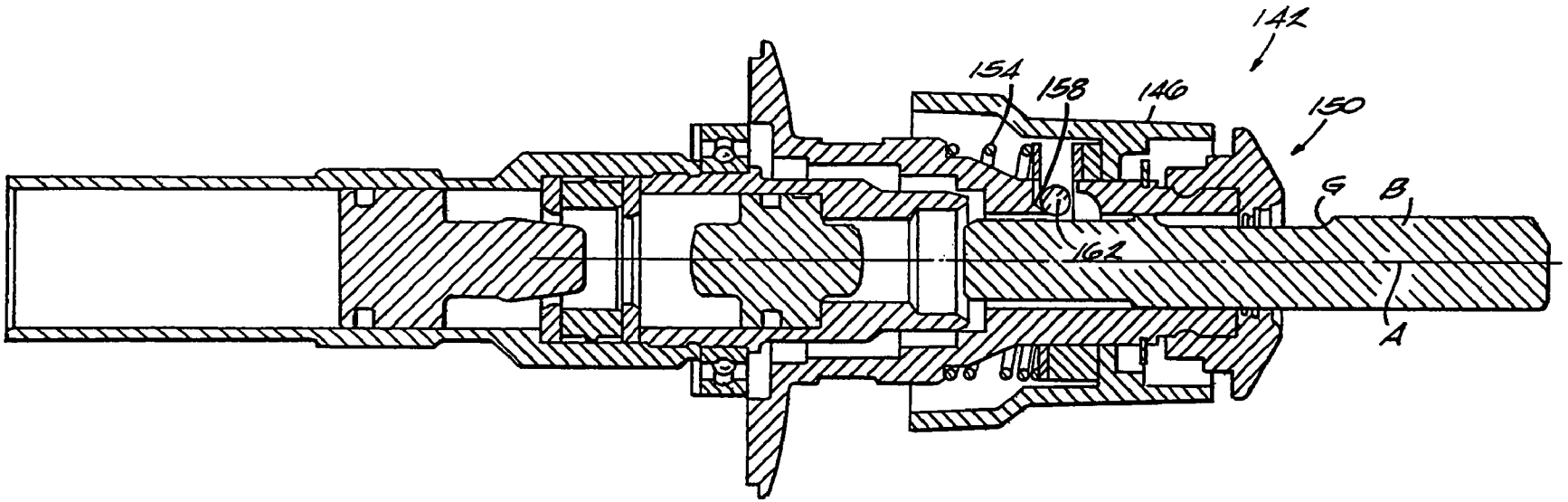
FIG. 6B us a partial cross-sectional side view of the bit retainer device shown in FIG. 6A in an unlocked position.
Figure 7:
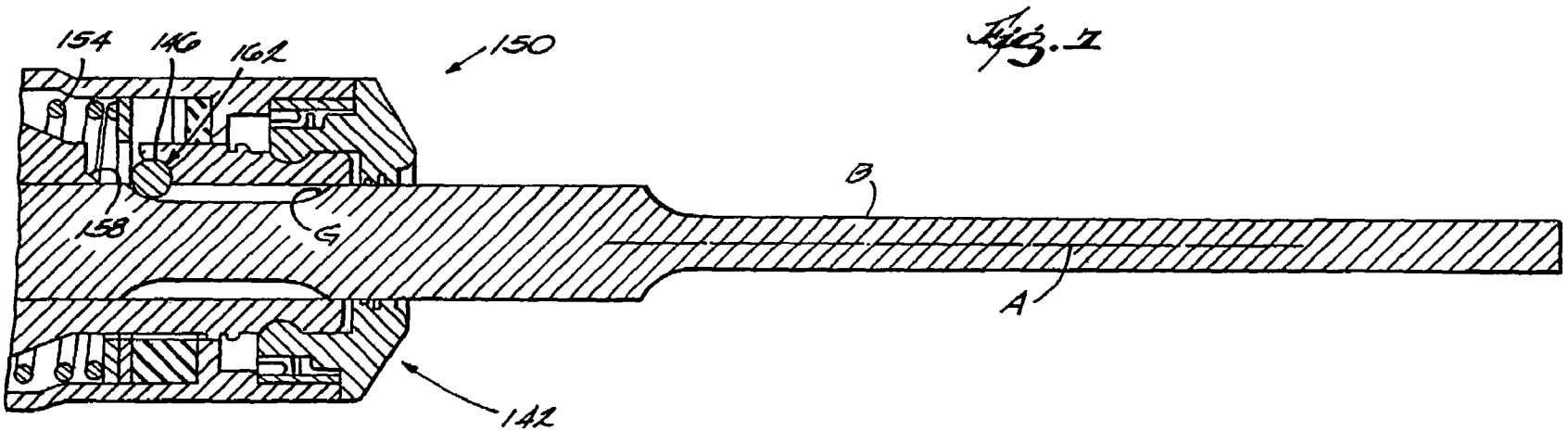
FIG. 7 is another partial cross-section side view of the bit retainer device shown in FIG. 6.
Figure 8:
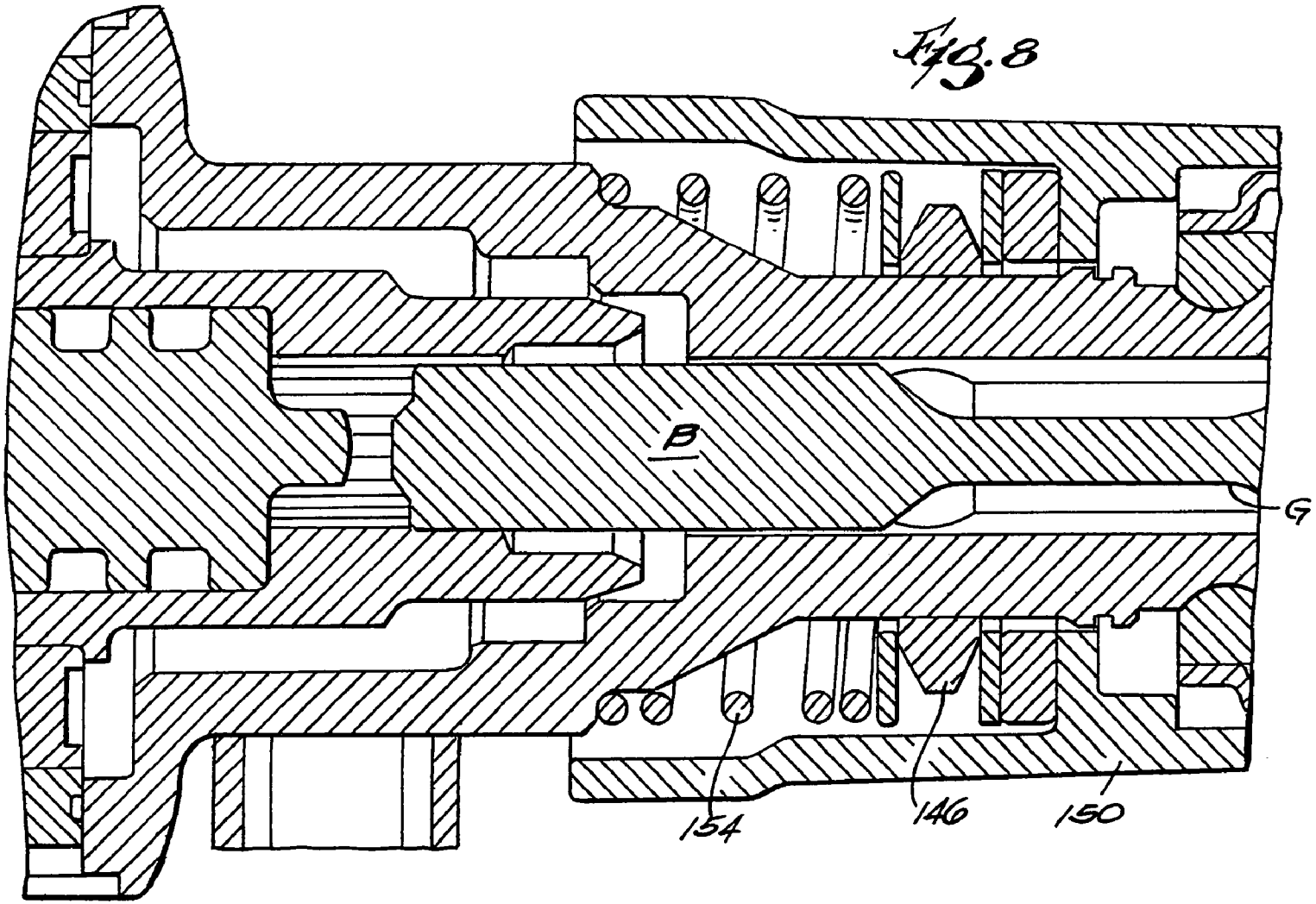
FIG. 8 is an enlarged partial cross-section bottom view of the bit retainer device shown in FIG. 6.

FIGS. 6A, 6B, 7 and 8 illustrate an alternative construction of a bit retainer device 142 for some aspects of the invention. The bit retainer device 142 includes a transversely-extending bitlock pin 146 radially movable into and out of engagement with the groove G in the bit B. The bit retainer device 142 also includes an actuator 150 for moving the bitlock pin 146 between a locked position (shown in FIGS. 6A, 7 and 8), in which the bitlock pin 146 engages the groove G to retain the bit B in the chuck 34, and an unlocked position (shown in FIG. 6B), in which the bitlock pin 146 is moved radially outwardly, out of engagement with the groove G so that the bit B is removable from the chuck 34. As shown in FIG. 8, the opposite ends of the bitlock pin 146 are engaged at the forward and rearward sides by the actuator 150 to ensure proper movement of the bitlock pin 146 between the locked and unlocked positions. The bit retainer device 142 also includes (see FIGS. 6A, 6B, 7 and 8) a biasing member or spring 154 biasing the actuator 150 and the bitlock pin 146 to the locked position.

In operation, as the bit B is inserted into the chuck 34, the rearward end of the bit B engages the transversely-extending bitlock pin 146. The bitlock pin 146 is allowed to move rearwardly up a ramp 158 and radially outwardly until the groove G is axially aligned with the bitlock pin 146. The bitlock pin 146 then moves forwardly down the ramp 158 and radially inwardly to engage the groove G.

During operation of the hammer 10, the bit B can move forwardly and rearwardly relative to the bitlock pin 146 along the longitudinal extent of the groove G. As shown in FIG. 6, forward movement of the bit B against the bitlock pin 146 causes the bitlock pin 146 to engage a locking surface 162 preventing outward radial movement of the bitlock pin 146 and preventing the bit B from moving out of the chuck 34.

To remove the bit B, the actuator 150 is moved rearwardly against the biasing force of the spring 154, and the bitlock pin 146 is moved rearwardly up the ramp 158 and radially outwardly to disengage from the groove G (as shown in FIG. 6B). The bit B may then be removed from the chuck 34.

Figure 9:
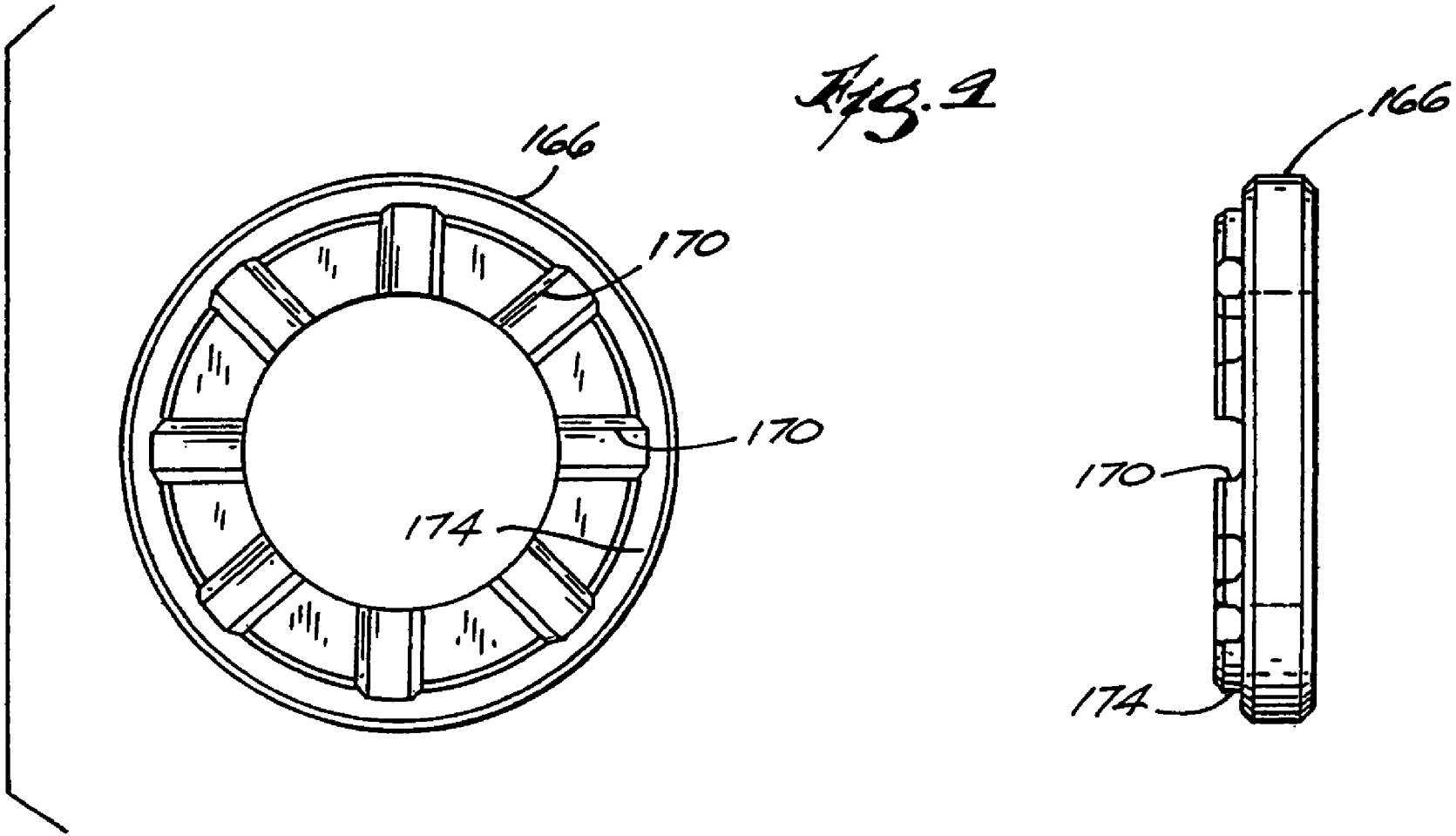
FIG. 9 are views of an alternative construction of a damping washer.

An alternative construction of a damping washer 166, in an aspect of the invention, is illustrated in FIG. 9. As shown in FIG. 9, the damping washer 166 includes radially extending grooves 170 communicating with an annular grove 174. Additional washers (not shown) may be provided on at least one axial end of the damping washer 166 to form a washer stack. The grooves 170 and 174 allow air to pass across the damping washer 166 to cool the damping washer 166 and to cool the washer stack. Also, radial openings (not shown) may be provided through the barrel (not shown) of the reciprocating drive system to further provide cooling air and facilitate air movement across the damping washer 166 and across the washer stack. In other constructions (not shown), the damping washer 166 may include radial and axially-extending holes to allow air to pass through the damping washer and other washers in the washer stack.

The damping washer 166 and the washer stack may be substituted for the damping member 118 of the ram catcher assembly 110. Alternatively, the damping member 118 can be formed with cooling features similar to those of the damping washer 166.

The damping washer 166 is cooled to maintain the physical properties of the damping washer 166 and of the washer stack in a constant and predictable state. Also, cooling of the damping washer 166 and the washer stack prevents the likelihood of the damping washer 166 and/or the washer stack failing due to the heat created by an impact from the ram (not shown).

Figure 10:
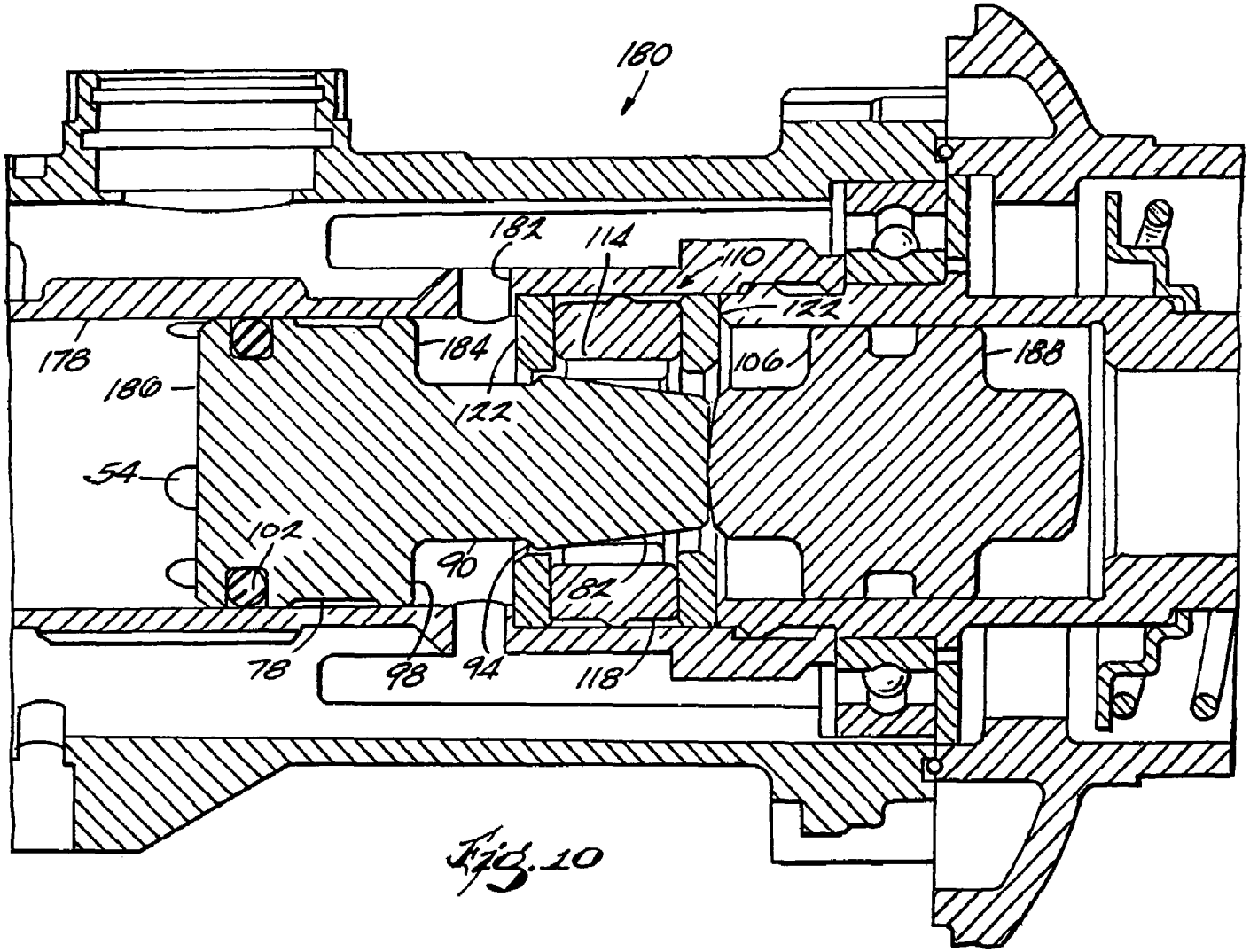
FIG. 10 is a partial cross-sectional side view of an alternative construction of a barrel.
Figure 11:
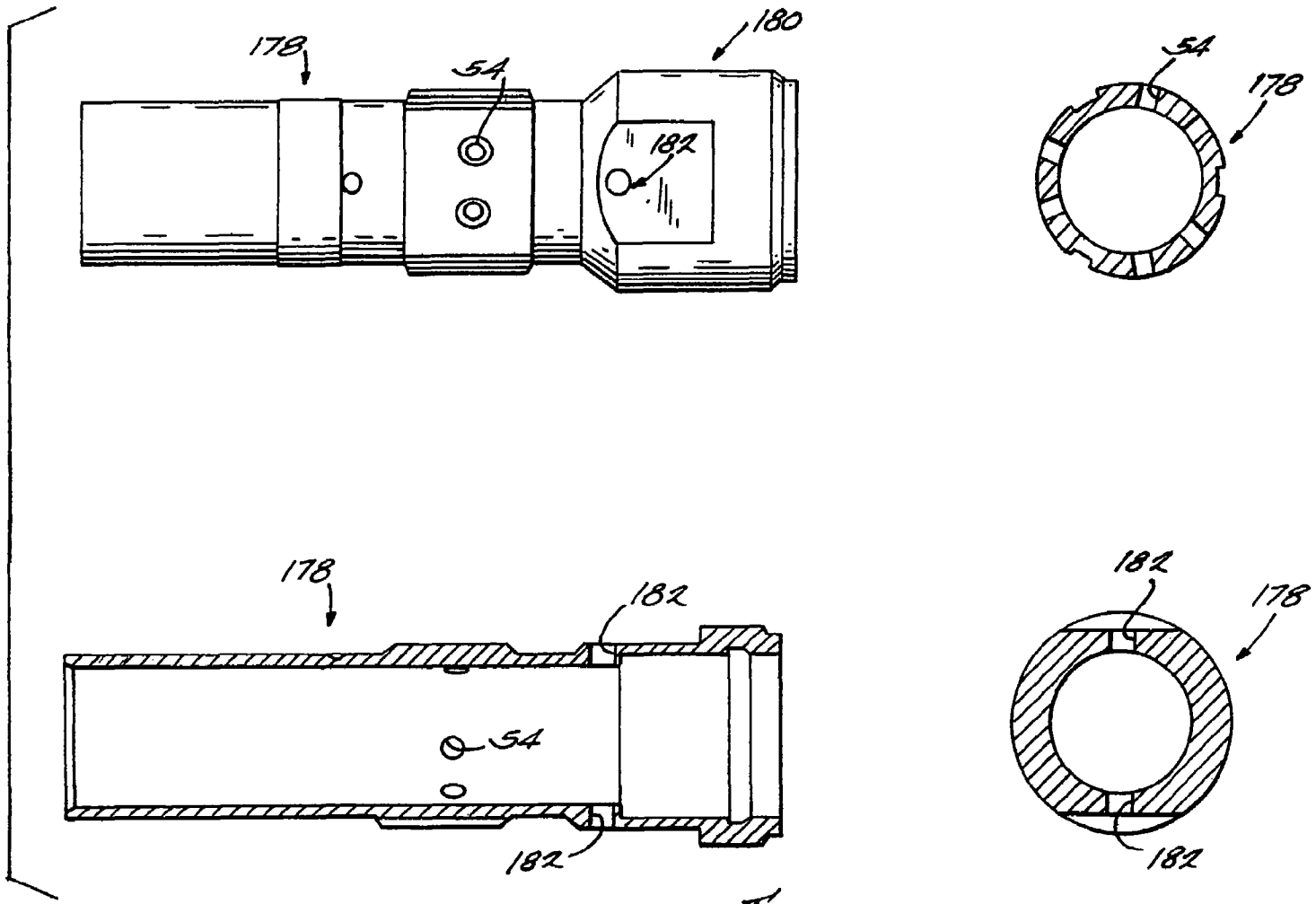
FIG. 11 are views of the barrel shown in FIG. 10.

An alternative construction of a barrel 178 providing an air brake ram catcher 180 in an aspect of the invention is illustrated in FIGS. 10 and 11. As shown in FIGS. 10 and 11, the barrel 178 defines at least one air brake port 182 in the forward end of the barrel 178. Preferably, the barrel 178 defines a plurality of ports 182, and the ports 182 are sized to capture a volume of air 184 being compressed between the ram 186 and the striker 188. The barrel 178 may define a second set of air brake ports (not shown) at a different axial position to accomplish the necessary braking. The compressed air applies a positive pressure on the leading face of the ram 186, reducing the velocity of the ram 186 as the ram 186 moves to the idle position, and the ports 182 are configured to, after the ram 186 has been slowed sufficiently, release the volume of air 184 to allow the ram 186 to move to the idle position.

It should be understood that, while the volume of air 184 is being captured, excess air may be vented from the ports 182 prior to the volume of air 184 being released (to allow the ram 186 to move to the idle position).

The ports 182 are located in a forward axial position along the barrel 178 to provide appropriate braking pressure during the transition to idle mode but so that, during hammer mode, the air will not compress and affect the velocity of the ram 186. The air brake ram catcher 180 absorbs the force of the ram 186 as it moves to idle position and prevents the ram 186 from rebounding so that the hammer 10 does not return to hammer mode.

Generally, the ram 186 has a given mass and moves at a given velocity with a given force to the idle position. With these known factors and in accordance with this aspect of the invention, the volume of air 184 to be captured, the braking force to be applied by the volume of air 184 to slow the ram 186, and the release rate of the volume of air 184 (to allow the ram 186 to move to the idle position) can be determined.

For example, in the illustrated construction, the barrel 178 has an inner diameter of approximately 1.125 inches, and the port 182 has a diameter of approximately 0.036 inches. The ram 186 has a mass of approximately 140 grams, and as the ram 186 moves to the idle position, the ram 186 moves with energy of about 10 lb-ft.

With the air brake ram catcher 180, a volume of air 184 (approximately 2.5 cubic inches) is captured and compressed between the ram 186 and the striker 188 to apply a positive pressure or braking force of approximately 40 lbs/square inch on the leading face of the ram 186, reducing the energy of the ram 186 from 10 lb-ft to approximately 2 lb-ft as the ram 186 moves to the idle position. Thereafter, the volume of air 184 is released through the ports 182 at a rate of about 0.2 cubic ft/second to allow the slowed ram 186 to move to the idle position. However, it should be understood that the size, shape, and proportion of the various elements within the air brake ram catcher 180 can be changed without departing from the spirit and scope of this aspect of the invention.

The embodiments described above and illustrated in the drawings are presented by way of example only and are not intended as a limitation upon the concepts and principles of the present invention. As such, it will be appreciated by one having ordinary skill in the art, that various changes in the elements and their configuration and arrangement are possible without departing from the spirit and scope of the present invention as set forth in the appended claims.

For example, some constructions may include two or more of the ram catcher 110, the breather port 134 in the crank shaft 62, the bit retainer device 142, the damping washer 166, and the air brake ram catcher 180. Alternatively, other constructions may include only one of the ram catcher 110, the breather port 134 in the crank shaft 62, the bit retainer device 142, the damping washer 166, and the air brake ram catcher 180. As such, the functions of the various elements and assemblies of the present invention can be changed to a significant degree without departing from the spirit and scope of the present invention.

What is claimed is:

1. A power tool comprising:

a body housing a motor, including a wall defining an interior portion housing grease, and at least partially defining a labyrinth path, the labyrinth path having an inlet communicating with the interior portion and an outlet communicating with atmosphere; and a drive mechanism driven by the motor and supported in the body, the drive mechanism including a shaft extending through the interior portion, the shaft defining an axis and supporting a slinger surface for rotating movement about the axis relative to the wall to prevent the grease from entering the inlet of the labyrinth path.

2. The power tool of claim 1, wherein the axis is substantially aligned with the inlet of the labyrinth path.

3. The power tool of claim 1, wherein the labyrinth path includes at least two turns, each turn being oriented at an angle of at least about ninety degrees.

4. The power tool of claim 1, further comprising a permeable cover positioned along the labyrinth path.

5. The power tool of claim 1, wherein operation of the power tool causes pressure buildup in the interior portion, the pressure being vented from the interior portion through the labyrinth path.

6. The power tool of claim 1, wherein at least a portion of the slinger surface extends beyond the inlet of the labyrinth path in a direction measured along the axis.

7. The power tool of claim 1, wherein the slinger surface extends circumferentially around at least a portion of the shaft and rotates relative to the wall about the axis along an eccentric path.

8. The power tool of claim 1, wherein the shaft includes an end extending through the wall, and wherein the shaft defines a breather port in the end communicating with the labyrinth path.

9. The power tool of claim 8, wherein the slinger surface is positioned adjacent to the breather port.

10. A power tool comprising:

a body housing a motor, including a wall defining an interior portion, and at least partially defining a labyrinth path, the labyrinth path having an outlet communicating with atmosphere and an inlet communicating with the interior portion along an axis, grease being housed in the interior portion; and a drive mechanism driven by the motor and including a slinger surface supported in the interior chamber for movement relative to the wall to prevent the grease from entering the inlet of the labyrinth path, at least a portion of the slinger surface extending beyond the inlet of the labyrinth path in a direction measured along the axis.

11. The power tool of claim 10, wherein the drive mechanism includes a shaft extending through the interior portion, and wherein the slinger surface is supported on the shaft adjacent to the inlet for rotating movement about the axis relative to the housing.

12. The power tool of claim 11, wherein the shaft includes an end extending through the wall, and wherein the shaft defines a breather port in the end communicating with the labyrinth path.

13. The power tool of claim 11, wherein the slinger surface extends circumferentially around at least a portion of the shaft and rotates relative to the housing about the axis along an eccentric path.

14. The power tool of claim 10, wherein the labyrinth path includes at least two turns, each turn being oriented at an angle of at least about ninety degrees.

15. The power tool of claim 10, further comprising a permeable cover positioned along the labyrinth path.

16. The power tool of claim 10, wherein operation of the power tool causes pressure buildup in the interior portion, the pressure being vented from the interior portion through the labyrinth path.

17. A power tool comprising:

a body housing a motor, including a wall defining an interior portion, and at least partially defining a labyrinth path, the labyrinth path having an outlet communicating with atmosphere and an inlet communicating with the interior portion and defining an axis, grease being housed in the interior portion; and a drive mechanism driven by the motor and including a slinger surface rotatable about the axis relative to the housing along an eccentric path to prevent the grease from entering the inlet of the labyrinth path.

18. The power tool of claim 17, further comprising a shaft extending through the interior portion, and wherein the slinger surface is supported on the shaft adjacent to the inlet for rotating movement about the axis relative to the housing.

19. The power tool of claim 18, wherein the shaft includes an end extending through the wall, and wherein the shaft defines a breather port in the end communicating with the labyrinth path.

20. The power tool of claim 19, wherein the slinger surface is positioned adjacent to the breather port.

21. The power tool of claim 18, wherein the slinger surface extends circumferentially around at least a portion of the shaft and rotates relative to the housing about the axis along an eccentric path.

22. The power tool of claim 17, wherein the labyrinth path includes at least two turns, each turn being oriented at an angle of at least ninety degrees.

23. The power tool of claim 17, further comprising a permeable cover positioned along the labyrinth path.

24. The power tool of claim 17, wherein operation of the power tool causes pressure buildup in the interior portion, the pressure being vented from the interior portion through the labyrinth path.

25. The power tool of claim 17, wherein the power tool is a rotary hammer having a chuck for supporting a tool element, and wherein the drive mechanism is operable to reciprocate the tool element along a substantially linear travel path relative to the tool body.

26. A power tool comprising:

a body housing a motor, including a wall defining an interior portion housing grease, and including an opening extending through the wall and communicating between the interior portion and atmosphere; and a drive mechanism driven by the motor and supported in the body, the drive mechanism including a shaft extending through the interior portion, the shaft defining an axis and supporting a slinger surface for rotating movement about the axis relative to the wall to prevent the grease from entering the opening in the wall, the axis being substantially aligned with the opening.

27. A power tool comprising:

a body housing a motor, including a wall defining an interior portion housing grease, and including an opening extending through the wall and communicating between the interior portion and atmosphere; and a drive mechanism driven by the motor and supported in the body, the drive mechanism including a shaft extending through the interior portion, the shaft defining an axis and supporting a slinger surface for rotating movement about the axis relative to the wall to prevent the grease from exiting the interior portion through the wall, at least a portion of the slinger surface extending toward the opening in the wall in a direction measured along the axis.

* * * * *